US010928014B2

(12) United States Patent
Kuppens et al.

(10) Patent No.: US 10,928,014 B2
(45) Date of Patent: Feb. 23, 2021

(54) LIGHTING MODULE

(71) Applicant: SIGNIFY HOLDING B.V., Eindhoven (NL)

(72) Inventors: Simon Jacobus Maria Kuppens, Geldrop (NL); Anna Wilhekmina Maria Wondergem-De Best, Veldhoven (NL); Ties Van Bommel, Horst (NL); Alexander Henricus Waltherus Van Eeuwijk, Eindhoven (NL); Genevieve Martin, Udenhout (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/631,387

(22) PCT Filed: Jul. 10, 2018

(86) PCT No.: PCT/EP2018/068660
§ 371 (c)(1),
(2) Date: Jan. 15, 2020

(87) PCT Pub. No.: WO2019/016032
PCT Pub. Date: Jan. 24, 2019

(65) Prior Publication Data

US 2020/0217461 A1 Jul. 9, 2020

(30) Foreign Application Priority Data

Jul. 20, 2017 (EP) ..... 17182276

(51) Int. Cl.
*F21K 9/65* (2016.01)
*F21V 29/70* (2015.01)
(Continued)

(52) U.S. Cl.
CPC ..... *F21K 9/65* (2016.08); *F21K 9/237* (2016.08); *F21K 9/68* (2016.08); *F21V 7/0008* (2013.01);
(Continued)

(58) Field of Classification Search
CPC ... F21K 9/65; F21K 9/237; F21K 9/68; F21K 9/02; F21K 9/04; F21K 9/06; F21K 9/232;
(Continued)

(56) References Cited

U.S. PATENT DOCUMENTS 8,702,279 B2 * 4/2014 Oki ..... F21V 29/15 362/294
9,482,391 B2 * 11/2016 Su ..... F21V 29/51
(Continued)

FOREIGN PATENT DOCUMENTS

DE 102013204041 A1 9/2014
JP 2011238580 A 11/2011
(Continued)

*Primary Examiner* — Joseph L Williams
*Assistant Examiner* — Jose M Diaz
(74) *Attorney, Agent, or Firm* — Daniel J. Piotrowski

(57) ABSTRACT

A lighting module (1) for use in a luminaire, comprising a heat sink (10) for dissipating thermal energy, which heat sink (10) is polygonal in cross section, forming a number of surfaces (11, 12) corresponding to the polygonal shape of the heat sink (10), each surface (11, 12) extending in a longitudinal direction, said longitudinal direction extending substantially perpendicularly to a plane of said cross section, each surface (11, 12) having a centre line (19) extending in said longitudinal direction, at least two LEDs (13, 14) being located on each of at least three of said surfaces (11, 12), wherein all of the LEDs (14) on a first (12) of said at least three surfaces (11, 12) defines an accumulated light emitting area of said first surface (12), which accumulated light
(Continued)

emitting area is distributed asymmetrically in relation to the centre line (19) of said first surface (12).

15 Claims, 5 Drawing Sheets

(51) Int. Cl.

| | |
|---|---|
| ***H05B 45/10*** | (2020.01) |
| ***F21V 7/00*** | (2006.01) |
| ***F21K 9/237*** | (2016.01) |
| ***F21K 9/68*** | (2016.01) |
| ***F21Y 115/10*** | (2016.01) |

(52) U.S. Cl.
CPC ..... *F21V 29/70* (2015.01); *H05B 45/10* (2020.01); *F21Y 2115/10* (2016.08)

(58) Field of Classification Search
CPC ..... F21K 9/64; F21V 7/0008; F21V 29/70; F21V 29/713; F21V 29/004; F21V 29/83; F21V 29/15; F21V 29/71; H05B 45/10; F21Y 2115/10
See application file for complete search history.

(56) References Cited

U.S. PATENT DOCUMENTS

| | | | | |
|---|---|---|---|---|
| 2011/0089830 | A1* | 4/2011 | Pickard | F21V 29/54 315/32 |
| 2011/0273072 | A1 | 11/2011 | Oki | |
| 2012/0080994 | A1 | 4/2012 | Chin et al. | |
| 2013/0062641 | A1* | 3/2013 | Lin | F21V 29/58 257/98 |
| 2014/0198495 | A1 | 7/2014 | Hu | |
| 2015/0241042 | A1 | 8/2015 | Berends | |
| 2015/0308630 | A1 | 10/2015 | Bendtsen et al. | |
| 2020/0116344 | A1* | 4/2020 | Dassanayake | F21V 31/005 |

FOREIGN PATENT DOCUMENTS

| | | | |
|---|---|---|---|
| JP | 2014167896 | A | 9/2014 |
| JP | 2015125849 | A | 7/2015 |
| JP | 2015153639 | A | 8/2015 |
| KR | 968270 | B1 | 7/2010 |
| WO | 2016154156 | A1 | 9/2016 |
| WO | 2017067793 | A1 | 4/2017 |

* cited by examiner

LIGHTING MODULE

CROSS-REFERENCE TO PRIOR APPLICATIONS

This application is the U.S. National Phase application under 35 U.S.C. § 371 of International Application No. PCT/EP2018/068660, filed on Jul. 10, 2018, which claims the benefit of European Patent Application No. 17182276.0, filed on Jul. 20, 2017. These applications are hereby incorporated by reference herein.

FIELD OF THE INVENTION

The invention relates to a lighting module for replacing gas-discharge arc lamps of an existing gas-discharge lamp luminaire, a luminaire comprising such a lighting module, and a method for replacing a gas-discharge lamp with such a lighting module.

BACKGROUND OF THE INVENTION

Gas-discharge lamps, especially High Pressure Sodium (HPS) arc lamps, are widely used for road and residential lighting, decorative floodlighting, commercial and industrial applications, and recreational sports facilities that are both indoor and outdoor. Such lamps comprise a bright arc which emits light in an omnidirectional way and is placed in the optical center of a reflector of a luminaire, which collects and redirects the light to, for example, a road. The high brightness property and the high lumen output of such lamps make them well suited for illuminating big outdoor areas, such as roadways, parking lots, and pavements.

Nevertheless, one of the major issues with gas-discharge lamps is their high power consumption, which along with a limited lifetime make them costly in terms of use of electricity and continuous replacement. Furthermore, such lamps may suffer from poor color rendering as their emission spectrum is often limited by the emission spectrum of the gas inside the lamp. Thus, there has been a great motivation to replace such lamps with more energy-efficient alternatives, without reducing the light intensity output.

To this end, various LED (Light Emitting Diode) configurations have been proposed to replace these high brightness—high lumen output lamps. LED lamps have a much more efficient lumen to power ratio than gas-discharge lamps, and have also a longer lifetime before the lamp needs replacing. However, because gas-discharge lamps are widely used in urban infrastructures, such as street lights, which would be costly to replace, the LED replacement should be capable of operating in the already existing luminaries. Therefore, the proposed LED replacements should be compatible with the existing luminaries, i.e. be compatible with the existing socket and mimic the omnidirectional light emission of the gas-discharge lamps such that the light emitted from a replacement LED lamp is reflected properly when the LED lamp is positioned in the optical center of the reflector of the luminaire.

In the prior art, LED lamps with a hexagonally shaped heat sink has been developed, where each side of the hexagonally shaped heat sink comprises an LED light source. The heat sink is made to be elongated, such that the light emitted by the LED lamp closely resembles the omnidirectional light of an arc lamp.

An example of such an LED lamp is disclosed in the document KR968270B1 which relates to an LED lamp for a street light, where LEDs have been arranged on the surfaces of an elongated hexagonal heat sink.

However, replacing the existing gas-discharge lamps with such LED lamps presents some issues. To achieve the required lumen output, the heat sink of the LED lamp needs to be of considerable dimensions, such that the heat produced by the LEDs have sufficient surface area to dissipate from. This results in a spacious heat sink which may act as an obstacle for light being reflected by the reflector towards the light window of the reflector, thereby creating a shadowing effect, which results in a loss of light and thereby reduces the efficiency of the LED lamp.

A further issue arises as the mounting sockets used for the gas-discharge lamps are not designed to take the final, mounted orientation of the lamp into consideration as gas-discharge lamps are mostly continuously rotationally symmetric about their longitudinal axis. For the LED lamps which, due to their polygonal cross-section, are only discretely rotationally symmetric about their longitudinal axis, the surfaces of the heat sink may end up with a final, mounted position, wherein the surfaces of the heat sink are orientated in a non-optimal manner in relation to the reflector and the light window of the reflector.

In view of the above, it is an object of the present invention to provide a lighting module suitable for direct replacement of conventional high brightness gas-discharge arc lamps, without modification of the associated luminaire, and which shows improved efficiency.

US 2011/0273072 discloses a light bulb with an enclosure, a heat-dissipating unit and a lamp unit. The heat-dissipating unit includes a hollow first heat-dissipating element disposed in the inner space, a second heat-dissipating element surrounded by the first heat-dissipating element and extending along the axial direction, and an end heat-dissipating element mounted to the second heat-dissipating element at a distal end thereof. The lamp unit includes a first circuit board disposed at a periphery of the first heat-dissipating element, a second circuit board mounted on the end heat-dissipating element, and a plurality of light-emitting elements mounted on the first and second circuit boards for emitting light beams.

SUMMARY OF THE INVENTION

In a first aspect of the invention, these and other objects may be achieved by a lighting module for use in a luminaire, comprising a heat sink for dissipating thermal energy, which heat sink is polygonal in cross section, forming a number of surfaces corresponding to the polygonal shape of the heat sink, each surface extending in a longitudinal direction, said longitudinal direction extending substantially perpendicularly to a plane of said cross section, i.e. at an angle of approximately 90 degrees to the plane of the cross section, each surface having a centre line extending in said longitudinal direction, at least two LEDs being located on each of at least three of said surfaces, wherein all of the LEDs on a first of said at least three surfaces defines an accumulated light emitting area of said first surface, which accumulated light emitting area is distributed asymmetrically in relation to the centre line of said first surface.

It should be noted, that the LEDs need not be provided by standard Light-emitting diodes, but may also be provided by other types of light emitting semi-conductor diodes, such as laser diodes.

The above mentioned problems relating to the heat sink shadowing the light emitted by the lighting module and reflected by a reflector of a luminaire are particularly troublesome for light emitted from a point of origin and in a direction where the light will hit the surface of the reflector, in which the lamp is mounted, orthogonally or substantially orthogonally on the surface of the reflector, as this light will mainly be reflected back in the direction from where it originated, thus being reflected back towards the heat sink. The lighting module of the invention may reduce the amount of light reflected back towards the heat sink as the accumulated light emitting area of the first surface may, at least in part, be distributed apart or shifted from the centre line of the first surface. Light emitted from this area may therefore, when the lighting module is mounted in a luminaire, to a larger degree be emitted in a direction which is not radially outwards from an optical center of the reflector.

Each LED provides a light emitting area, which is the surface of the LED emitting light from the lamp. The accumulated light emitting area is the accumulated area of the individual light emitting areas of each of the LEDs of the surface in question. When the lamp is off, the accumulated light emitting area is the area of the surface in question, which emits light when the lamp is on.

The accumulated light emitting area being distributed asymmetrically should be understood as more of the accumulated light emitting area provided by the LEDs of the first surface being located on one side of the centre line of the first surface than on the other side of the centre line of the first surface, i.e. the at least two LEDs arranged on the first surface are positioned a closer distance to one of the neighboring surfaces than the other neighboring surface.

In an embodiment of the invention, 75% of the accumulated light emitting area of the first surface is located on one side of the centre line of said surface and 25% of the accumulated light emitting area of the first surface is located on the other side of the centre line. This may be achieved by distributing the at least two LEDs of the first surface in two rows with the same number of LEDs in each row, one row being located along the centre line, i.e. half of the partial light emitting area provided by said row being one side of the centre line and the other half being located on the other side of the centre line, and one row being fully located on one side of the centre line.

In another embodiment of the invention, substantially all or all of the of the accumulated light emitting area of the first surface is located on one side of the centre line. This may be accomplished by displacing all of the at least two LEDs of the first surface to the same side of the centre line. Preferably the at least two LEDs of the first surface are arranging in a row extending in the longitudinal direction parallel with the centre line. The advantage of this is that less of the light emitted from the first surface will hit the surface of the reflector at an orthogonal or substantially orthogonal angle. The amount of light exiting the light window may thereby be increased and the overall efficiency of the luminaire may be increased.

By mounting the lighting module of the invention such that the first surface faces a surface of the reflector, i.e. face into the reflector and not towards the light window, the amount of light emitted from the first surface orthogonally onto the reflector is reduced, thereby increasing the amount of light exiting the light window of the reflector. Thereby, a lighting module for replacing conventional gas-discharge lamps without modification of the associated luminaire and with improved efficiency may be achieved. Furthermore, the light distribution and light emission of the lighting module in the luminaire may be optimized and rendered more efficient.

The centre line of each said surface of the heat sink may be defined as a virtual or imaginary line extending in the longitudinal direction through one or more cross-sectional mid-points of the surface.

The lighting module may further comprise a base, a plug part, a support part, or a fitting part, which may fit into a socket of a luminaire or light fitting, providing power to the lighting module and supporting it in the luminaire or light fitting. The plug part may be provided with an external thread, fitting an internal thread of a luminaire socket, especially in the situation where the lighting module replaces an existing arc lamp. The plug part may alternatively be provided with pins fitting into the luminaire socket. The lighting module may further comprise a PCB (Printed Circuit Board), an LED driver, a base and/or other members that are usual in LED lamps. It should be noted that although the lighting module of the invention is suited to be mounted in a luminaire for gas-discharge lamps, it may alternatively also be adapted for LED lamp luminaries, such that some components of the lighting module may be omitted, for example a driver, or other types of luminaire.

The heat sink may have a substantially cylindrical shape. Cylindrical may be defined as the heat sink having two parallel base sides or ends, where a cross-section of the heat sink may be circular, elliptical or polygonal, such as triangular or square, the two base sides or ends being joined by a side surface extending substantially straight in the longitudinal direction between the two base sides. The side surface may be curved or round or may comprise a plurality of surface parts, where the surface parts may each be planar, straight, curved, and/or extend in a zig-zag shape. Said surfaces of the lighting module according to the invention may be provided as such surface parts, each forming part of a side surface of the heat sink. The heat sink may work as a heat exchanger in order to dissipate heat generated by the LEDs, whereby a temperature of the LEDs may be moderated.

The term "located on the surface" as used in this specification may include, e.g., that the LED is located in or embedded in a cut-out, cavity or depression of the surface. Similarly, the LEDs may be positioned on one or more elements positioned between the LEDs and the heat sink, such as a holding plate. The LEDs may be covered, for example, by a protective, substantially transparent film, while still being "located on the surface".

A reflector in a luminaire, in which the LED may be positioned, may reflect light that is emitted in other directions than directions towards a light exit window of the luminaire, such that this light may, at least partly, be reflected in the direction of the light exit window.

The light exit window may be defined as an aperture or a main aperture of the luminaire from which the light from the LED exits, or mainly exists, the luminaire. Usually, the light exit window is located substantially oppositely from the reflector of the luminaire, such that the light reflected by the reflector will exit the light exit window. The light exit window may be the only, or substantially the only, opening from which light may exit the luminaire. The reflector and the light exit window may together surround the lighting module so that all, or substantially all, light emitted from the lighting module is directed towards the reflector or towards the light exit window.

In an embodiment of the invention, the at least two LEDs of each of the at least three of said surfaces are arranged in one or more rows on each surface, said rows extending in the longitudinal direction such that the lighting module better mimics the light emission of an arc lamp.

The number of LEDs per row and/or surface may be varied, and may be at least two, three, four, five, six, seven, eight, ten, fifteen, twenty, fifty, eighty, a hundred or more, whereby the light output may be varied. The number of LEDs per row and/or surface may similarly be less than three, four, five, six, seven, eight, ten, fifteen, twenty, fifty, eighty, or a hundred. Preferably, the number of LEDs per row and/or surface is two to forty, three to thirty, four to twenty, or six to ten.

In an embodiment of the invention, the LEDs of the first surface cover 10 to 60% of the surface area of the first surface, preferably, 20 to 55% of the surface area of the first surface, more preferably 25 to 50% of the surface area of the first surface. By only covering a portion of the surface area of the first surface, the efficiency of the lighting module of the invention may therefore, when mounted in a luminaire designed for gas-discharge lamps, be increased. This is because less energy is consumed to produce light which would be emitted in a direction, where it would hit the surface of the reflector of the luminaire orthogonally and be reflected back onto the heat sink.

In an embodiment of the invention, the polygonal cross-sectional shape of the heat sink is substantially a triangle, square, quadrilateral, pentagon, hexagon, heptagon, or octagon, and is preferably substantially a regular polygon. Because LEDs primarily emit light perpendicularly from their light emitting surface are, it may be desirable to increase the number of sides of the polygonal cross-sectional shape of the heat sink such that the lighting module will be able to mimic the omnidirectional light emission of an arc lamp better. However, because the polygonal cross-sectional shape may inherently be discretely rotationally symmetrical, i.e. the lighting module emits more light perpendicularly to the surfaces of the heat sink where the LEDs are arranged, the cross-sectional shape of the heat sink may be chosen depending on the reflector in which the lighting module is to be mounted.

Therefore, in an embodiment of the invention, the number of surfaces is in the range from 3 to 8, preferably in the range from 4 to 7, More preferably in the range from 5 to 6.

In an embodiment of the invention, at least some of the at least two LEDs on the first surface are arranged in a row extending in the longitudinal direction. Hereby, the light emitted from the first surface may mimic the light of an arc lamp. To provide an accumulated light emitting area which is distributed asymmetrically in relation to the centre line, the row of LEDs may be displaced or shifted from the center line such that the row of LEDs extends parallel to, but spaced apart from or overlapping, the centre line.

In an embodiment, one or more, such as every second LED, in the row has been displaced from the row, such as from the remaining LEDs of the row, preferably in a direction perpendicular on the longitudinal direction, potentially so as to increase the distance between neighboring LEDs of said row. By shifting every second LED, the distance between neighboring LEDs is increased, whereby thermal management may be improved.

In an embodiment of the invention, the row of LEDs is arranged close to an edge of the first surface, preferably next to or at or adjoining said edge of the first surface. By arranging the row close to one of the edges, e.g. one of the edges of the heat sink which forms a corner of the polygonal cross-section, the accumulated light emitting area will be shifted far from the center line, such that the light emitted from the first surface, when the lighting module is installed in a luminaire, may be emitted from an area of origin spaced apart or shifted from an optical centre of a reflector of a luminaire, in which the lighting module may be positioned, and in a direction, which does not extend radially away from the optical centre, whereby a reduced amount of the light emitted from the first surface will hit the reflector surface orthogonally.

In an embodiment of the invention no LEDs are placed on the centre line. As the light emitted from LEDs arranged along the centre line, when the lighting module is mounted in a luminaire and activated, may be more likely to be emitted in a direction, where it will strike the surface of the reflector orthogonally, it may be advantageous to omit LEDs placed on the centre line.

In an embodiment of the invention, the first surface comprises a reflective area. Such a reflective area can be provided by at least a portion of the first surface which is not covered by the at least two LEDs, possibly all or most of the first surface which is not covered by the at least two LEDs. By making the first surface reflective to visible light, the shadowing effect of the heat sink will be reduced, as light reflected back onto the heat sink from the reflector will be reflected once again rather than be absorbed by the first surface.

In an embodiment of the invention, the reflective area is provided by a reflective coating or layer. In such embodiments, the reflective area may comprise a silver or aluminum layer applied on top of the first surface of the heat sink, e.g. by using physical vapor deposition (PVD), or a layer of $Al_2O_3$ and/or $BaSO_4$ and/or $TiO_2$ particles in a polymer matrix. The advantage of this will be a higher reflectivity of light hitting the reflective area, whereby a larger portion of this light may be reflected back, thus reducing the amount of light lost due to absorption by the heat sink.

In an embodiment, the reflectivity of the reflective area is at least 80%, preferably at least 85%, more preferably at least 88% such as for example 90%.

In an embodiment of the invention, at least one of the LEDs on the first surface is arranged along the centre line of said surface, and the lighting module further comprises an LED driver capable of varying the electrical current to the at least one LED arranged along the centre line independently of the other LEDs of the first surface.

This allows the lighting module of the invention to selectively emit light from the first surface from the at least one LED arranged along the centre line and/or from the at least one LED arranged apart from the centre line, whereby the lighting module may selectively emit light from a symmetric or asymmetric partial light emitting area. Such configurations further enhance the versatility of the lighting module of the invention, making it compatible with a wider range of luminaires.

In an embodiment of the invention, the heat sink has an elongated polygonal shape in cross section, wherein the first surface has a greater cross-sectional width than at least some of the other surfaces. Hereby, the at least two LEDs of the first surface may be displaced a greater distance from the centre line, thus increasing the asymmetric distribution of the accumulated light emitting area.

In an embodiment of the invention, several, preferably all, of said at least three surfaces are configured like the first surface. By distributing the at least two LEDs of at least three of said surfaces such that one or more of the surfaces that are not the first surface are configured similar to the first surface, i.e. have a cross-sectional width and an accumulated light emitting area distributed similar to the first surface, the amount of light from these other surfaces that is emitted to intersect the reflector surface orthogonally or substantially orthogonally may be reduced, and the overall amount of light reaching the light window may be increased.

In embodiments, wherein multiple of at least three of said surfaces are configured like the first surface, and wherein at least one of the LEDs on the first surface is arranged along the centre line of said surface, the lighting module may further comprise an LED driver capable of varying the electrical current to the at least one LED arranged along the centre line independently from the other LEDs of the first surface. The LED driver may also or alternatively be capable of varying the electrical current to the at least one LED arranged along the centre line of the other surfaces independently of the other LEDs of the respective surface. Through such configurations, the lighting module of the invention may selectively emit light symmetrically or asymmetrically from each of the surfaces configured like the first surface by only providing power to a portion of the accumulated light emitting area of each surface. This provides the lighting module of the invention a greater versatility as the light emission distribution may be controlled actively.

In an embodiment of the invention, the at least two LEDs being located on each of said at least three of said surfaces are distributed on said surfaces such that the cross section of the heat sink and LEDs is discretely substantially rotationally symmetrical. This may be achieved by providing all of said at least three surfaces having LEDs with an accumulated light emitting area distributed identically to or similar to the first surface on each surface.

This may be particularly relevant when the lighting module is to be mounted in a socket, wherein the final orientation of the lamp cannot be controlled, e.g. a screw socket. By making the lighting module of the invention substantially rotationally symmetrical about the longitudinal axis, the axis extending through a cross-sectional centre of the heat sink in the longitudinal direction, the spatial light emission pattern from each surface will be identical or similar. It may therefore be ensured that a surface with an asymmetrical accumulated light emitting area will be facing the reflector, regardless of the lighting module's orientation with respect to the socket in which the lighting module is mounted.

In an embodiment, the lighting module comprises a rotation mechanism allowing the heat sink and/or rows of LEDs to be rotated with respect to a socket of the lighting module. This may be achieved by providing a rotation mechanism as it is disclosed in US2012080994A1 or US2015241042A1, the contents of which are hereby included herein in their entirety.

By including ring electrodes in the rotation mechanism as disclosed in these documents, the heat sink may be rotated independently of the base of the lighting module, thus allowing the first surface to be oriented such that the first surface faces the reflector of a luminaire and not the light window, when the lighting module is mounted in a luminaire.

In an embodiment of the invention, the rotation mechanism comprises a manual adjustment mechanism, such that the heat sink may be rotated into a set position by a user. This may allow the person installing the lighting module of the invention in a luminaire to orient the first surface correctly with respect to the reflector, regardless of the position of the base of the lighting module with respect to the socket of the luminaire.

In another embodiment of the invention, the rotation mechanism may comprise an automatic adjustment mechanism, such that the heat sink may be rotated into a set position. This facilitates installation of the lighting module as the rotation mechanism may orient the first surface towards the reflector without special attention from the person installing the lighting module.

In such an embodiment of the invention, the rotation mechanism is configured so that the heat sink, due to the pull of gravity, rotates into a set position when the lighting module is installed in a luminaire or light fitting. Said set position may be so that the first surface, when the lamp is connected to a power source, points upwards, i.e. in a direction substantially opposite a direction of earth gravity. The rotation mechanism may comprise a counterweight arranged opposite the first surface so that the rotation mechanism will orientate the first surface upwards, and thereby towards the reflector, when the lighting module is installed in a luminaire or light fitting.

In and embodiment of the invention, the counterweight is integrated with the heat sink. This may be achieved by making the heat sink denser at one of the surfaces, preferably a surface opposite the first surface.

In an embodiment of the invention, the lighting module comprises a sensor adapted for sensing an orientation of the lighting module in relation to the luminaire when the lighting module is installed in the luminaire. Such a sensor may be configured to sense a position of a reflector and/or light exit window of the luminaire in which the lighting module is installed, whereby the sensor may determine the orientation of the first surface in relation to the reflector. The sensor may be a photo sensor or a photodetector adapted to detect light or other electromagnetic energy. The sensor converts light photons into current. The sensor may be of the type using detection mechanisms such as: photoemission, photoelectric, photovoltaic, thermal, polarization, photochemical, or weak interaction effects.

In an embodiment of the invention, the sensor comprises a photo sensor or a photodetector arranged on the first surface and adapted to detect light being reflected back towards the first surface. This may allow the sensor to determine whether the first surface faces the reflector or the light window of the reflector. The sensor may be adapted to detect the wavelength spectrum of sensed light, such that the sensor may distinguish light emitted by the lighting module from light from other sources.

The sensor may advantageously be connected to the rotation mechanism, thereby allowing the rotation mechanism to automatically adjust the orientation of the first surface. Additionally, in embodiments wherein at least one of the LEDs on the first surface is arranged along the centre line of said surface, and wherein the lighting module further comprises an LED driver capable of varying the electrical current to the at least one LED arranged along the centre line independently of the other LEDs of the first surface, the LED driver may be connected to the sensor, such that the LED driver may vary the electrical current based on the orientation of the first surface.

While the rotation mechanism may facilitate positioning of the lighting module, it is not requirement to do so. In any embodiment of the invention, the fixation means, e.g. the base of the lighting module and the socket of the luminaire, may, when the lighting module is installed in the luminaire, be adapted to or be readjusted, to fixate the orientation of the lamp, whereby the lighting module may improve the luminaire efficiency even without the rotation mechanism.

In an embodiment of the invention, the lighting module comprises a heat pipe to improve dissipation of thermal energy and/or to improve thermal management. More specifically, the heat pipe may improve dissipation of heat energy from one or more LEDs of the lamp. This may be achieved by including a heat pipe working as a heat transfer device and potentially combining the principles of thermal conductivity and phase transition to improve heat dissipation of thermal energy and thermal management. The heat pipe may be a constant conductance heat pipe, a vapor chamber, a variable conductance heat pipe, a pressure controlled heat pipe, a diode heat pipe, a thermosiphon, rotating heat pipe, or any other heat pipe type.

In an embodiment of the invention, the heat sink is quadrilateral or square in cross section so as to comprise four said surfaces, each surface comprising at least one row of LEDs with at least two LEDs in each row, wherein the at least one row of LEDs of the first surface is displaced from the centre line of the first surface such that the accumulated light emitting area is distributed asymmetrically with respect to the centre line of the first surface.

In an embodiment of the invention, the heat sink is hexagonal in cross section so as to comprise six surfaces, each surface comprising at least one row of LEDs with at least two LEDs in each row, wherein the at least one row of LEDs of the first surface is displaced from the centre line of the first surface such that the accumulated light emitting area is distributed asymmetrically with respect to the centre line of the first surface.

In a second aspect of the invention, the objects set forth in the background section and other objects may be achieved by a luminaire or a light fitting comprising a lighting module according to the first aspect of the invention and a reflector surface for reflecting light emitted from the lighting module, wherein the lighting module is fitted in the luminaire or light fitting such that the first surface faces a centre or centre line of the reflector surface; or faces in a direction opposite to a main illumination direction or a light exit window; or faces in a direction opposite to a direction of earth gravity.

By orienting the first surface towards the reflector, when the lighting module is mounted in a luminaire, less light is emitted to intersect the surface of the reflector orthogonally. More light is therefore reflected towards the light exit window or towards another surface of the reflector for a subsequent reflection.

The reflector may be substantially arc-shaped and/or have a substantially parabolic shape and/or a substantially semi-elliptical shape, specifically in a cross section, more specifically in a cross section taken along a longitudinally extending centre line of the lighting module. The luminaire may comprise one or more reflectors, such that one or more lighting modules may be fitted in the luminaire. The lighting module may be positioned substantially in an optical center of the reflector or luminaire or light fitting.

In a third aspect of the invention, the objects set forth in the background section and other objects may be achieved by a method for replacing a gas-discharge lamp, such as a High Pressure Sodium (HPS) lamp, in a luminaire with a reflector surface for reflecting light emitted from the gas-discharge lamp, the method comprising the steps of removing said gas-discharge lamp, providing a lighting module according to the first aspect of the invention, and mounting said lighting module such that the first surface substantially faces a centre or centre line of the reflector surface; or faces in a direction opposite to a main illumination direction or a light exit window; or faces in a direction opposite to a direction of earth gravity.

BRIEF DESCRIPTION OF THE DRAWINGS

These and other aspects of the present invention will now be described in more detail, with reference to the appended drawings in which.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and to fully convey the scope of the invention to the skilled person.

Figure 1:
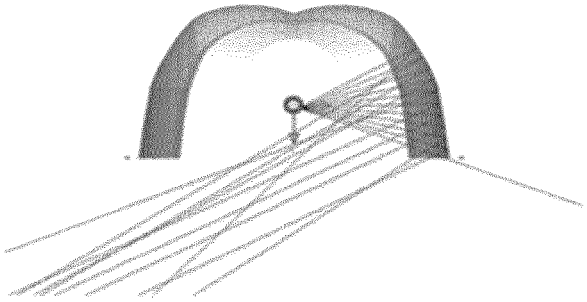
Fig. 1 (Prior art)
FIG. 1 shows a ray tracing simulation of a high pressure sodium lamp of the prior art mounted in a luminaire.

Turning first to FIG. 1, a ray tracing simulation of a High Pressure Sodium (HPS) lamp of the prior art mounted in a reflector of a luminaire is shown. The HPS lamp generates light by an electric arc, thereby emitting light omnidirectionally, both downwards towards a light window, i.e. the opening of the reflector and towards the reflective surface of the reflector. The ray tracing simulation is based on a reflector of a typical street lamp which have a cross-sectional shape adapted to reflect light downwards towards a street, wherein the HPS lamp is mounted horizontally extending along an optical center axis of the reflector. The reflector has an elongated shape with a substantially uniform cross-sectional shape along the optical center axis. Towards the ends of the reflector the two sides of the cross-section converge, such that the reflector forms a partially closed reflective surface around the lamp and forms a light window from which light emitted by the lamp may exit.

Figure 2:
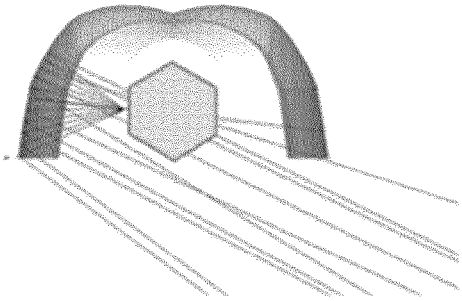
Fig. 2 (Prior art)
FIG. 2 shows a ray tracing simulation of an LED lamp of the prior art mounted in a luminaire.

FIG. 2 shows a similar ray tracing simulation, wherein the HPS lamp has been replaced by an LED lamp of the prior art. As mentioned in the background section, the LED lamp comprises a heat sink with a regular hexagonal cross-sectional shape. The heat sink extends in a longitudinal direction perpendicular to the plane of the cross-section, whereby the heat sink presents six major surfaces, i.e. the number of sides in the cross-sectional polygonal shape, outwards. On each surface, the LED lamp comprises a number of LEDs arranged in a row extending in the longitudinal direction along the central line of the respective surfaces, i.e. the line extending in the longitudinal direction through the cross-sectional mid-point of the side. The polygonal configuration allows such LED lamps to mimic the omnidirectional light distribution of the HPS lamp, thereby making it suitable for replacing HPS lamps in already existing luminaires.

However, as can be seen in FIG. 2, the heat sink occupies a substantial portion of the cross-sectional space inside the reflector. The heat sink, being made of metal or other opaque materials, therefore shadows a substantial amount of the light which is reflected by the reflector, such that the light is lost before exiting the light window. It should be noted that in FIG. 2, the heat sink is shown as being transparent. Therefore, the five rays that are reflected back at the heat sink can be seen being transmitted through the heat sink. In reality, a portion of the rays hitting the heat sink would be reflected once again while another portion would be absorbed, thus reducing the efficiency of the luminaire.

It should be noted, that the LED lamp of the invention relates to visible light, i.e. light from about 390 to 700 nm. When using terms like reflectivity, absorption and emission, it therefore should be construed as for light near or within the visible spectrum.

Figure 3:
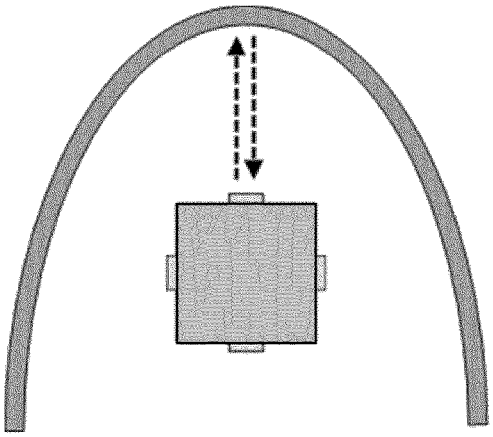
Fig. 3 (Prior art)
FIG. 3 shows an LED lamp of the prior art mounted in a luminaire with a parabolic reflector.

FIG. 3 shows another example of an LED lamp of the prior art, mounted in a luminaire with a reflector with a parabolic cross-sectional shape such as the one used in many operational street lights. Because LEDs have a spatial intensity distribution with a FWHM of about 120°, most of the light emitted from the surface facing the vertex of the reflector, i.e. the top of the parabolic cross-sectional shape, will hit the surface of the reflector at an orthogonal or substantially orthogonal angle. The light will therefore to a large extend be reflected back towards the LED lamp, which will block the light before it reaches the light window. Light emitted from along the central line of the surface facing the vertex of the reflector will mainly be emitted towards the vertex, from where it will be reflected back onto the heat sink, thus reducing the efficiency of the luminaire.

Figure 4A:
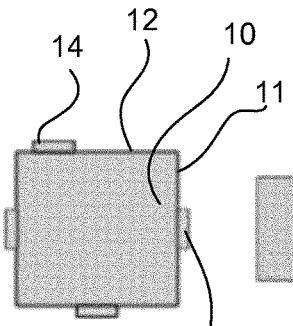
FIG. 4*a* shows a cross-sectional view of an embodiment of a lighting module according to the invention.
Figure 4B:
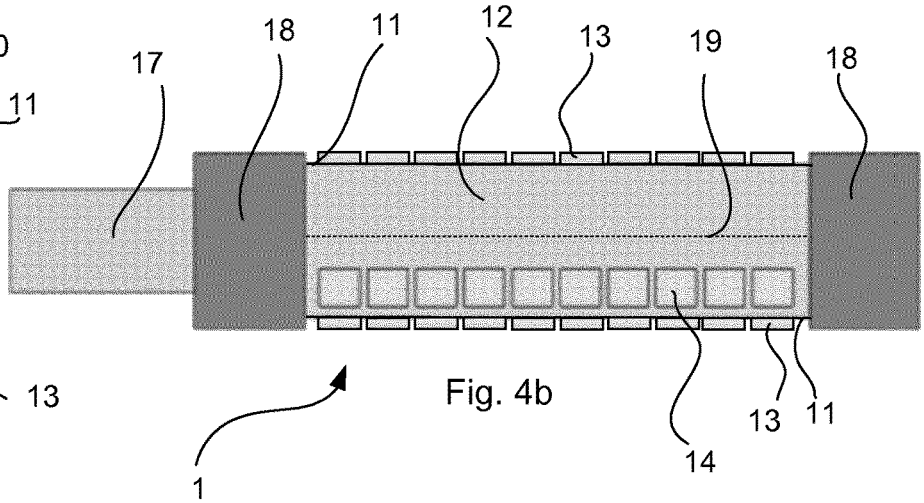
FIG. 4*b* shows a top view of an embodiment of a lighting module according to the invention.

FIGS. 4*a* and 4*b* show an embodiment of a lighting module of the invention from a cross-sectional view and a top view, respectively. The lighting module 1 comprises a heat sink 10 which is elongated in a longitudinal direction and which has a polygonal cross-sectional shape. In the shown embodiment the cross-sectional shape is quadrilateral, whereby the lighting module 1 presents four surfaces 11, 12. The shown lighting module 1 comprises rows of LEDs 13 arranged along the centre lines 19 of some of the surfaces 11 of the heat sink 10, such that the lighting module 1 may emit light radially outwards from the centre lines 19 of these surfaces 11, thereby mimicking the omnidirectional light of an arc lamp. The lighting module 1 is adapted to reduce the problem arising from the lighting module 1 shadowing for itself when mounted and emitting light in a reflector 2 of a luminaire. To solve this issue, the lighting module 1 comprises a first surface 12 amongst the surfaces 11, 12 of the heat sink 10. The first surface 12 comprises a number of LEDs 14 arranged, which LEDs 14 define an accumulated light emitting area of the first surface 14. The LEDs 14, and thereby the accumulated light emitting area, is distributed asymmetrically in relation to the centre line 19 of said first surface 14. Light emitted from the first surface 12 will therefore primarily not be emitted radially outwards from the centre line 19 of the first surface 12, and will therefore to a lesser extend hit the surface 21 of the reflector 2 at an orthogonal angle.

The lighting module 1 further comprises a base 17 adapted to connect the lighting module 1 to a socket of the luminaire. As the lighting module 1 may be designed to replace conventional lamps, the socket of the luminaire and the base 17 will often be of the screw, bayonet, or pin type. As can be seen in FIG. 4*b*, the lighting module 1 further comprises a secondary heat sink 18 arranged at each longitudinal end of the heat sink 10. The secondary heat sinks 18 improves heat dissipation by providing a large surface area in contact with the ambient air.

Figure 5:
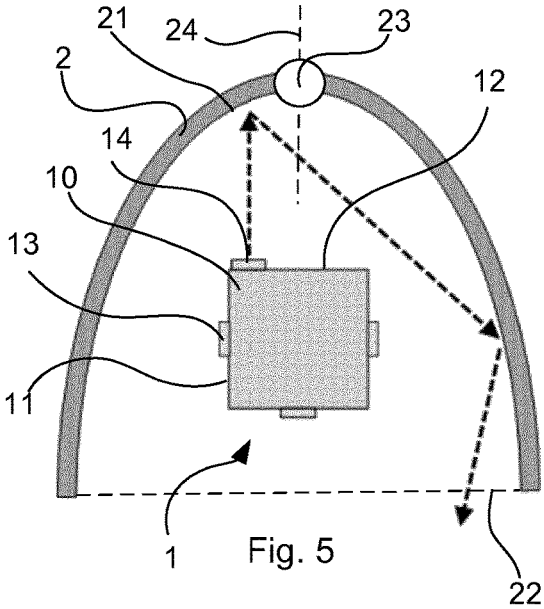
FIG. 5 shows an embodiment of a lighting module according to the invention mounted in a parabolic reflector of a luminaire.

Turning now to FIG. 5, an embodiment of the lighting module 1 of the invention is shown mounted in a parabolic reflector 2. The lighting module 1 is mounted such that the first surface 12 faces a vertex 23 of the parabolic reflector 2. Due to the asymmetric distribution of the accumulated light emitting area of the first surface 12, the light emitted from the LEDs 14 of the first surface 12 will therefore mostly not be emitted radially outwards from the centre line 19, thereby avoiding that the light hits the vertex 23 of the reflector 2 at an orthogonal angle. As can be seen in the drawing, the light is instead emitted asymmetrically with respect to both the centre line 19 of the first surface 12 and a center 24 of the reflector.

Light emitted from the accumulated light emitting area of the first surface 12 may therefore primarily hit the surface 21 of the reflector 2 at an angle different from 90 degrees, thereby reducing the amount of light reflected back towards the lighting module 1. Instead, the light emitted from the first surface 12 may be reflected towards another point on the surface 21 of the reflector 2, where it may be reflected once again. This may occur several times, before the light reaches and exits the light window 22 of the reflector 2.

Figure 6A:
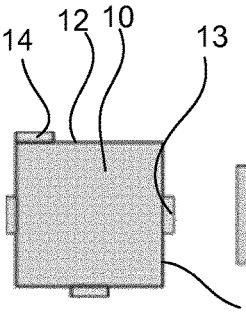
FIG. 6*a* shows a cross-sectional view of an embodiment of a lighting module according to the invention.
Figure 6B:
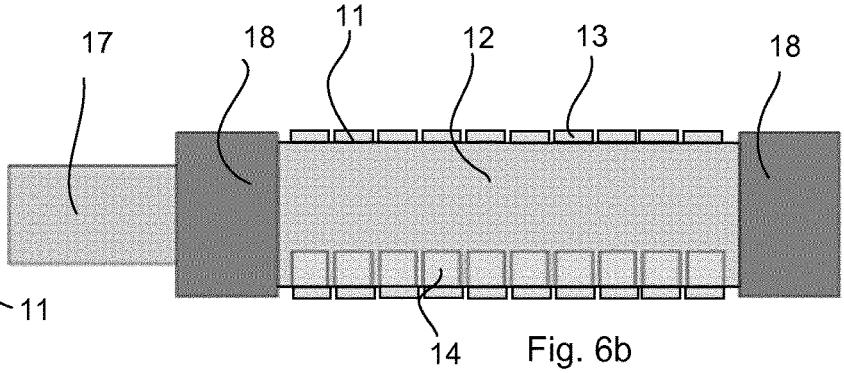
FIG. 6*b* shows a top view of an embodiment of a lighting module according to the invention.

FIGS. 6*a* and 6*b* show a lighting module 1 according to another embodiment of the invention from a cross-sectional view and a top view, respectively. The shown lighting module 1 is similar to the lighting module 1 shown in FIGS. 4*a* and 4*b*, but differs in that the LEDs 14 of the first surface 12 is arranged up against one of the edges of the first surface 12, i.e. one of the edges formed with a neighboring surface 11 in the cross-section. By arranging the LEDs 14 of the first surface like this, the accumulated light emitting area is displaced as much as possible from the centre line 19 of the first surface 12, thereby further increasing the efficiency of the lighting module 1 when it is mounted in a luminaire.

Figure 7A:
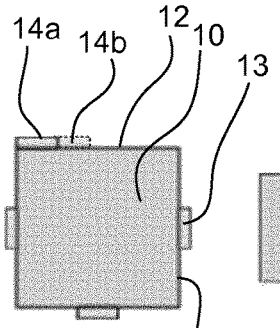
FIG. 7*a* shows a cross-sectional view of an embodiment of a lighting module according to the invention.
Figure 7B:
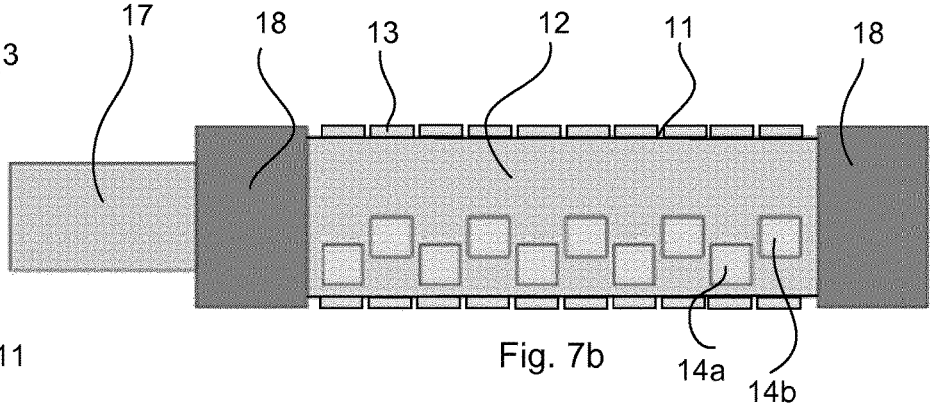
FIG. 7*b* shows a top view of an embodiment of a lighting module according to the invention.

FIGS. 7*a* and 7*b* show a lighting module 1 according to another embodiment of the invention from a cross-sectional view and a top view. In this embodiment, the LEDs 14*a*, 14*b* of the first surface 12 have been arranged in a row extending in the longitudinal direction, where every second LED 14*b* has been displaced towards the centre line 19, such that the distance to the neighboring LED 14*a* is increased. This may provide the lighting module 1 of the shown embodiment with an improved thermal management, due to the increased distance between neighboring LEDs 14*a*, 14*b*, which may lead to a decreased operational temperature, whereby the efficiency of the LEDs 14*a*, 14*b* is increased.

In general, the LEDs 13, 14 of this and other embodiments may be arranged in rows, wherein every second LED is displaced to increase the distance to the neighboring LEDs, regardless of which surface the row of LEDs is arranged on.

Figure 8:
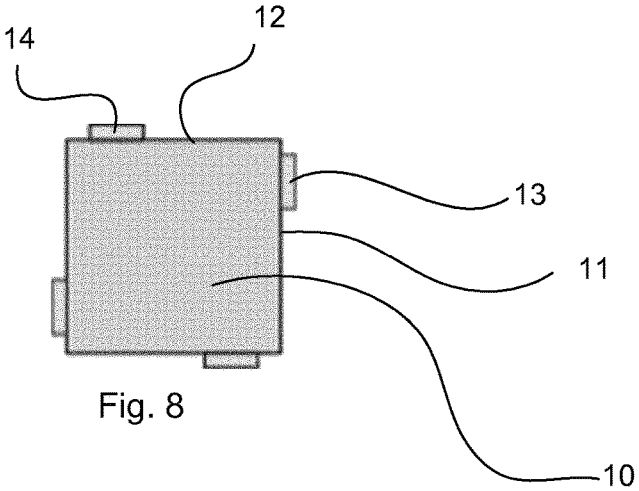
FIG. 8 shows a cross-sectional view of an embodiment of a lighting module according to the invention.

Turning now to FIG. 8, a cross-sectional view of a lighting module 1 according to another embodiment of the invention is shown. In this embodiment, all four surfaces 11, 12, i.e. the first surface 12 and the three other surfaces 11 that are not the first surface, are configured identically. This is achieved by arranging the LEDs 13, 14 on each of the four surfaces 11, 12 identically on their respective surface 11, 12 and providing the heat sink 10 with e regular polygonal cross-sectional shape, such that the cross section is discretely rotationally symmetrical.

An advantage of this is that the distance between the LEDs 13, 14 of neighboring surfaces 11, 12 is increased, such that heat dissipation from the heat sink 10 is improved, whereby the lighting module 1 achieves a lower operational temperature so that the LEDs 13, 14 may perform more efficiently. Another advantage of configuring the other surfaces 11 identically or substantially identically to the first surface 12, is that a discrete rotational symmetry about the longitudinal axis is achieved. Because the lighting module 1 of the invention is intended to replace conventional lamps, e.g. HPS lamps, it may often be difficult to control the orientation of the lighting module 1 when mounting it, as the sockets designed for conventional lamps rarely take the final position of the lamp into consideration, due to the continuous rotational symmetry of conventional lamps. By providing a lighting module 1, wherein the other surfaces 11 are configured like the first surface 12, it may be ensured, that a surface 11, 12 with an asymmetrically distributed accumulated light emitting area will face into the reflector 2 when the lighting module 1 is mounted.

Figure 9:
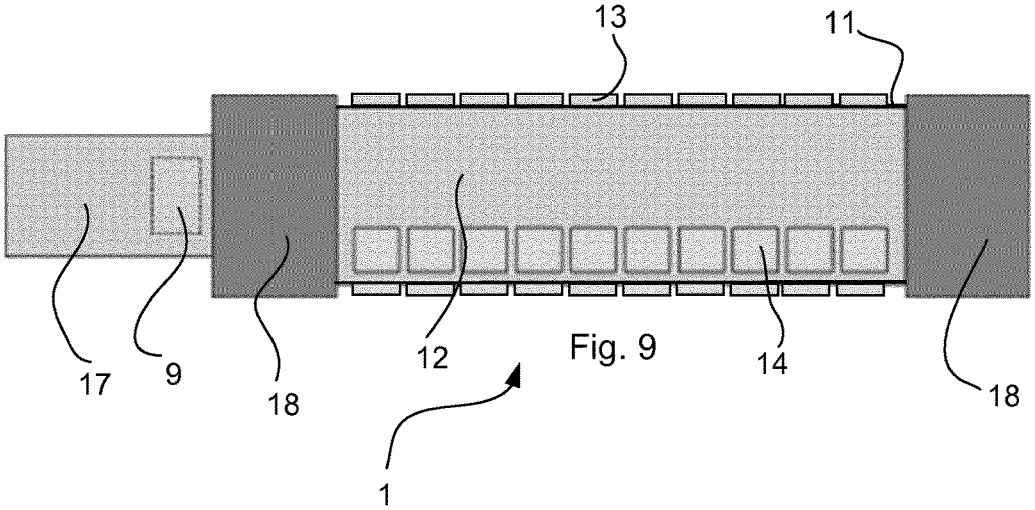
FIG. 9 shows a top view of an embodiment of a lighting module according to the invention.

FIG. 9 shows another embodiment of the invention. The shown lighting module 1 further comprises a controller 9 adapted to control the LEDs 13, 14 by providing a current to both the asymmetrically positioned LEDs 14 of the first surface 12, which in the mounted condition are facing the reflector 2, and to the LEDs 13 of the other surfaces 11. Furthermore, the controller 9 may comprise an LED driver adapted to convert and/or regulate the voltage of the luminaire to the voltage required to drive the lighting module 1, whereby the lighting module 1 becomes compatible with luminaires adapted for other types of lamps, e.g. HPS lamps. It should be noted, that the controller 9 is a general feature which may be incorporated into any embodiment of the invention. The controller 9 may be adapted to control the current to the LEDs 13, 14 of each respective surface 11, 12 individually, whereby the spatial light emission of the lighting module 1 may be controlled according to the shape of the reflector 2 and/or the light intensity may be controlled according to the ambient light.

Figure 10:
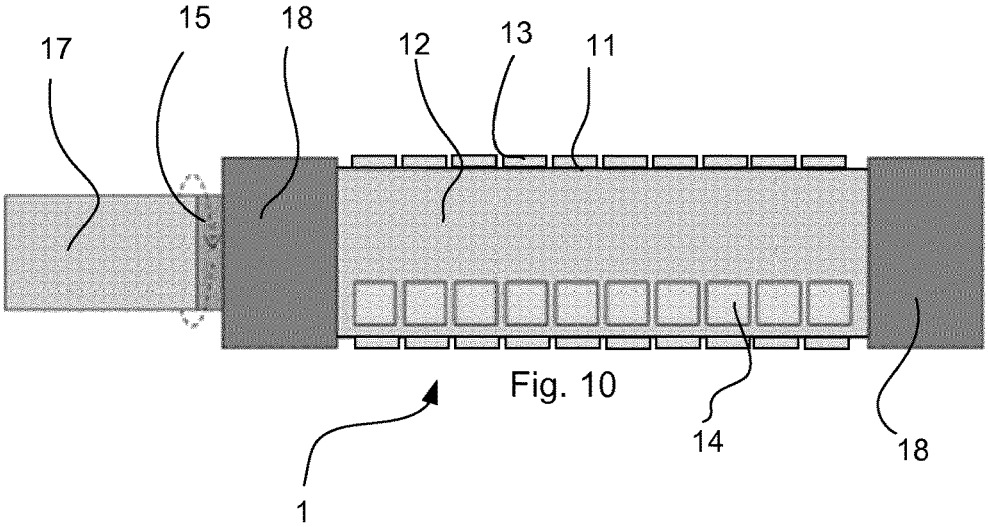
FIG. 10 shows a top view of an embodiment of a lighting module according to the invention.

Turning now to FIG. 10, another embodiment of the lighting module of the invention is shown from a top view. The shown lighting module 1 further comprises a rotation mechanism 15 which allows the heat sink 10 to rotate independently of the base 17. This allows the orientation of the surfaces 11, 12 of the lighting module 1 to be adjusted easily after mounting the lighting module 1 in a luminaire, whereby the first surface 12 may be oriented towards a predetermined point on the surface of the reflector 2, e.g. a center point or a vertex 23. Because the heat sink 10 and therefore also the first surface 12 may be rotated after the lighting module 1 is mounted in the socket of a luminaire, the lighting module 1 may replace conventional lamps, regardless of the type of socket in the luminaire and the final position of the base 17 when this is mounted in the socket. It should be noted, that the rotation mechanism 15 may be included in any embodiment of the invention.

The rotation mechanism 15 may be driven manually by hand, whereby the person installing the lighting module 1 into the luminaire may rotate the heat sink 10 after connecting the base 17 to the socket to orient the first surface 12 towards a set point on the surface 21 of the reflector 2.

In other embodiments, the rotation mechanism 15 may include an automatic adjustment mechanism adapted for automatically orienting the first surface 12 in a predetermined direction in relation to the luminaire when the lighting module 1 is installed in the luminaire. Such an automatic adjustment mechanism may be driven electronically by a motor, whereby the orientation of the first surface 12 and the other surfaces 11 may by adjusted continuously. This may be autonomously controlled by a controller 9 of the lighting module 1 or it may be controlled remotely through a wireless control unit. In other embodiments, the rotation mechanism 15 may be driven by gravity, such that the lighting module 1 positions itself into a predetermined position with respect to the gravitational field following installation into the luminaire. This may be achieved by providing the lighting module 1 with an un-even weight distribution, e.g. by providing the lighting module 1 with a counter-weight, whereby a heavier portion of the lighting module 1 will fall towards the lowest point in the gravitational field, i.e. the rotation mechanism 15 will rotate to minimize the potential energy of the mass of the lighting module 1. The first surface 12 may be opposite the heavier portion of the lighting module 1, such that the first surface 12 is oriented upwards with respect to the gravitational field when the rotation mechanism 15 rotates into its equilibrium.

Figure 11:
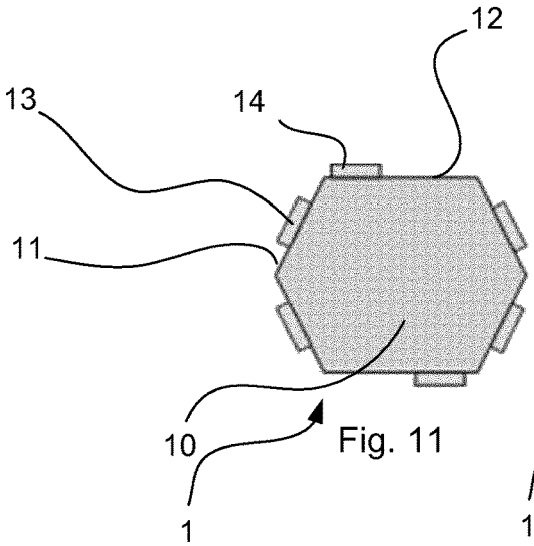
FIG. 11 shows a cross-sectional view of an embodiment of a lighting module according to the invention.
Figure 12:
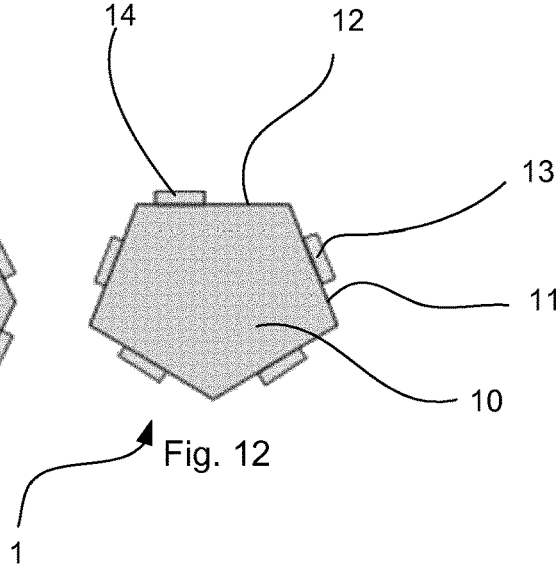
FIG. 12 shows a cross-sectional view of an embodiment of a lighting module according to the invention.

FIGS. 11 and 12 show cross-sectional views of two embodiments of the invention, wherein the cross-sectional shape of the heat sink 10 is hexagonal and pentagonal, respectively. By increasing the number of surfaces 11, 12 on the heat sink 10, the heat sink 10 may be provided with a higher order of rotational symmetry, thus allowing the lighting module 1 to mimic the omnidirectional light emission of an arc lamp better.

The spatial light emission of the lighting module 1 may be designed by choosing a number of surfaces 11, 12 depending on the shape of the reflector 2 and the desired emission direction. By providing a heat sink 10 with an even number of surfaces 11, 12 the heat sink 10 will be comprised of opposite, parallel surfaces 11, 12, thereby allowing that one surface, e.g. the first surface 12, may be oriented towards a vertex 23 of the reflector 2, when the lighting module 1 is installed, and the opposite surface may be oriented directly towards the light window 22, when the lighting module 1 is installed. This may be advantageous if a high light intensity perpendicularly away from the light window 22 is required, as one surface 11 may be arranged parallel with the light window 22. If it is required that the light exiting the light window 22 is less focused, i.e. less light is emitted perpendicularly away from the light window 22, the heat sink 10 may be provided with an odd number of surfaces 11, 12, whereby several of the other surfaces 11 may be directed towards the light window 22, when the lighting module 1 is installed and the first surface 12 faces the vertex 23 and/or center point 24 of the reflector 2.

In the embodiments shown in FIGS. 11 and 12, the first surface 12 is made wider, from a cross-sectional view, such that the LEDs 14 of the first surface, and thereby also the accumulated light emitting area, may be displaced further from the centre line 19. This may enhance the effect of the asymmetrical placement of the accumulated light emitting area, thereby further increasing the efficiency of the lighting module 1, when mounted in the luminaire. In general, the first surface 12 may be made wider than the other surfaces 11.

Figure 13:
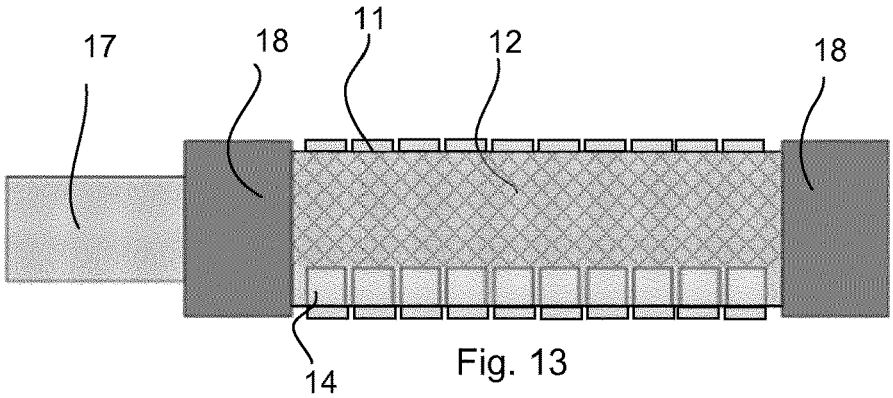
FIG. 13 shows a top view of an embodiment of a lighting module according to the invention.

FIG. 13 shows an embodiment of the invention similar to the one shown in FIGS. 6*a* and 6*b*. The shown embodiment further comprises a reflective area on most of the portion of the first surface 12 which is not covered by the accumulated light emitting area. The reflective area allows light which is reflected back towards the first surface 12, when the lighting module 1 is installed and active, to be reflected once again towards the reflector 2. The reflective area may be provided by coating the first surface 12 with a reflective material and/or by making the heat sink 10 from a material with a high reflectivity within the visible spectrum. Such reflective areas may also be provided on the other surfaces 11 and may also be incorporated into other embodiments.

Figure 14:
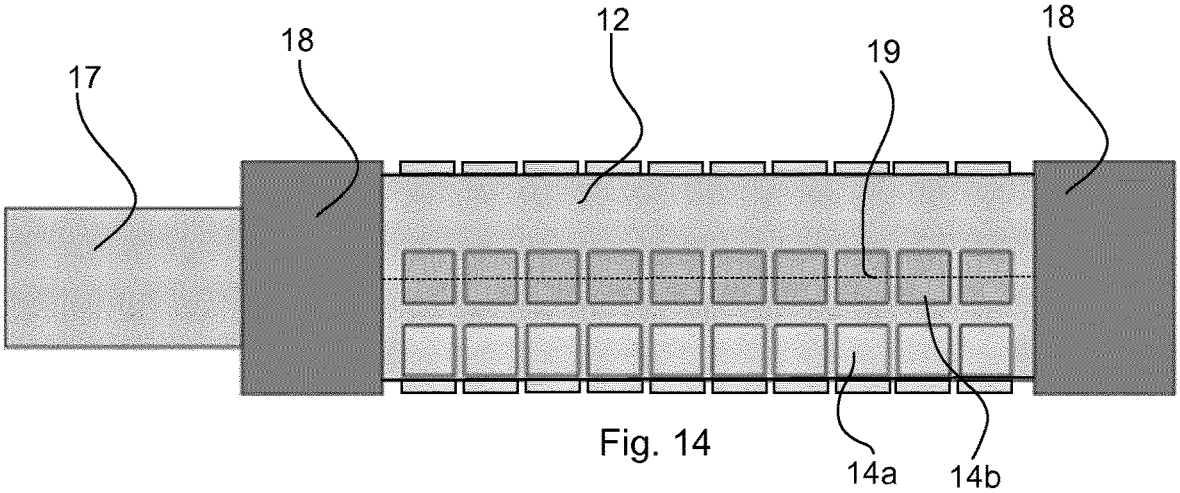
FIG. 14 shows a top view of an embodiment of a lighting module according to the invention.

Turning now to FIG. 14, in which an embodiment of the lighting module of the invention is seen from a top view, in the shown embodiment, the first surface comprises at least one LED 14*b* arranged along the centre line 19 and at least one LED 14*a* arranged apart from the centre line 19. The lighting module 1 is thereby provided by a symmetrically distributed partial light emitting area defined by the LED(s) 14*b* arranged along the centre line 19, and an asymmetrically distributed partial light emitting area defined by the LED(s) 14*a* arranged apart the centre line 19. The two partial light emitting areas thus make up the accumulated light emitting area.

To control light emission from the symmetric and the asymmetric partial light emitting areas, the lighting module 1 further comprises a controller 9 which is capable of controlling the current supplied to both the symmetric and the asymmetric partial light emitting areas individually. This allows the lighting module 1 to emit light from either or both partial light emitting areas, whereby the lighting module 1 may switch between a symmetric or an asymmetric spatial light distribution. Should the lighting module 1 be mounted such that the first surface 12 faces the light window 22 and not the reflector 2, the lighting module 1 may be configured to emit light symmetrically by only activating the LEDs 14*b* arranged along the centre line 19.

Figure 15:
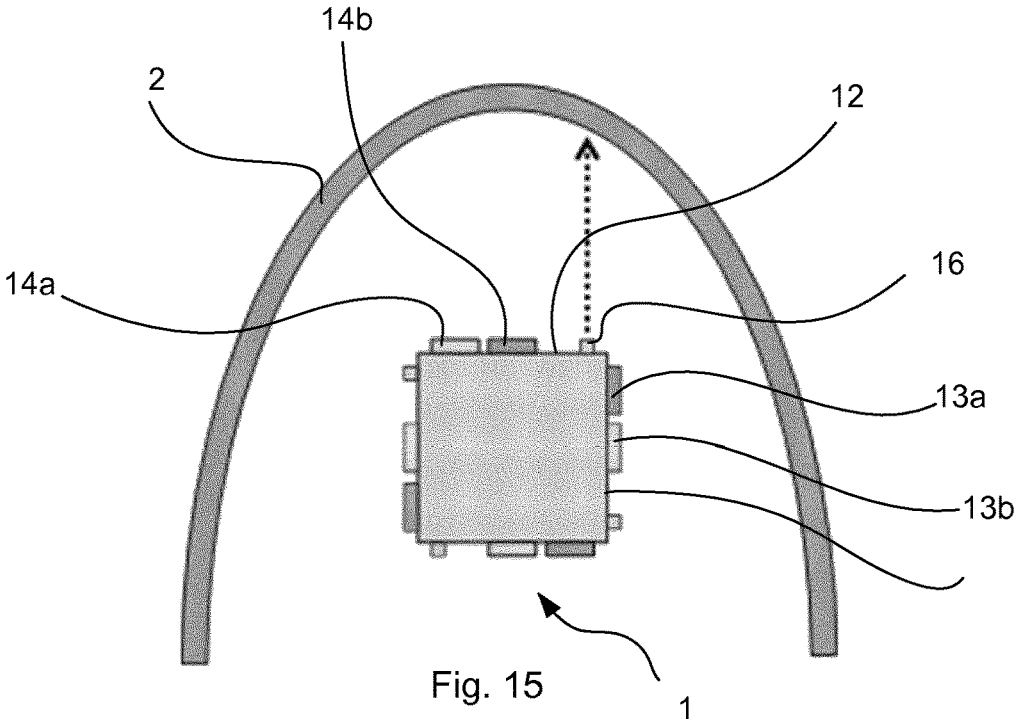
FIG. 15 shows an embodiment of a lighting module according to the invention mounted in a parabolic reflector of a luminaire.

As can be seen in FIG. 15, which shows an embodiment of the lighting module of the invention mounted in the reflector 2 of a luminaire from a cross-sectional view, the other surfaces 11 may also be provided with the configuration of the first surface 12 shown in FIG. 14, whereby each of the other surfaces 11 also comprises at least one LED 13*a* arranged apart from the centre line 19 and at least one LED 13*b* arranged along the centre line 19. In such embodiments, the controller may control the LEDs 13*a*, 13*b*, 14*a*, 14*b* of the first and the other surfaces 11, 12 independently, such that each of the first surface 12 and the other surfaces 11 may be configured to emit light symmetrically or asymmetrically with respect to the centre line 19 of the respective surface 11, 12. By providing such a lighting module 1, the final orientation of the lighting module 1 with respect to the reflector 2 may be trivial, as each of the first surface 12 and the other surfaces 11 can be configured to emit light asymmetrically.

To determine the orientation of the lighting module 1 when the lighting module 1 is installed, the lighting module 1 of FIG. 15 further comprises a sensor 16 adapted to sense the position of the lighting module 1 with respect to the reflector 2 and/or to the gravitational field. In the embodiment shown in FIG. 15, each of the first surface 12 and the other surfaces 11 comprise a sensor 16 arranged for sensing the reflector 2 and/or light exit 22. The controller 9 may then accordingly power the asymmetrical LEDs 14*a* of the surface facing the reflector 2 and the symmetric LEDs 13*b* of the surfaces 11 facing other directions. The sensor(s) 16 may be provided by a light detector adapted to measure the amount of light hitting a respective surface 11, 12. The sensor(s) 16 may then determine which of the surfaces 11, 12 faces the vertex 23 of the reflector 2, based on which sensor 16 measures the highest amount of reflected light.

Such sensors 16 may also advantageously be provided in embodiments comprising an automatically adjusting rotation mechanism 15. The rotation mechanism 15 may then position the lighting module 1 based on the position determined by the sensor(s) 16.

Figure 16:
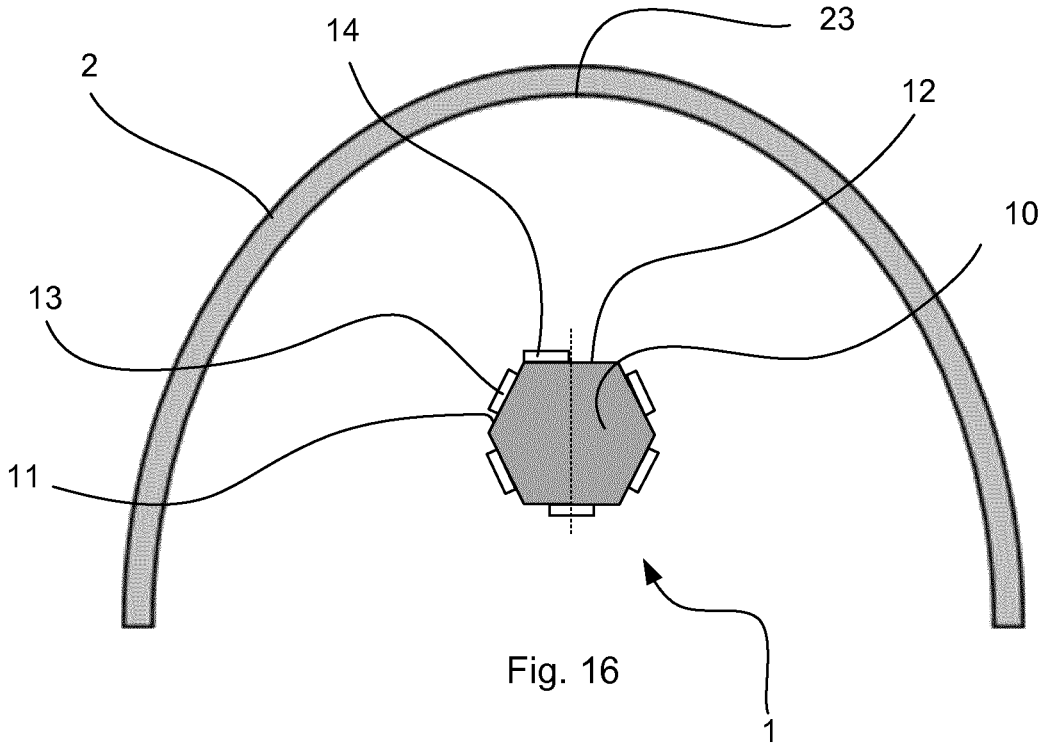
FIG. 16 shows an embodiment of a lighting module according to the invention mounted in a parabolic reflector of a luminaire.

FIG. 16 shows a cross-sectional view of an embodiment of the lighting module according to the invention with a hexagonal cross-sectional shape, mounted in the reflector 2 of a luminaire. As previously mentioned, such embodiments may better mimic the omnidirectional light emission of arc lamps, and may therefore be better suited for reflectors 2 of certain shapes.

In general, the any one of the above embodiments of the lighting module may further comprise a heat pipe to improve dissipation of thermal energy and/or to improve thermal management. This is achieved by having a heat pipe working as a heat transfer device and combining the principles of thermal conductivity and phase transition to improve heat dissipation of thermal energy and thermal management. The heat pipe may be a constant conductance heat pipe, a vapor chamber, a variable conductance heat pipe, a pressure controlled heat pipe, a diode heat pipe, a thermosiphon, rotating heat pipe, or any commonly used heat pipe type.

Figure 17:
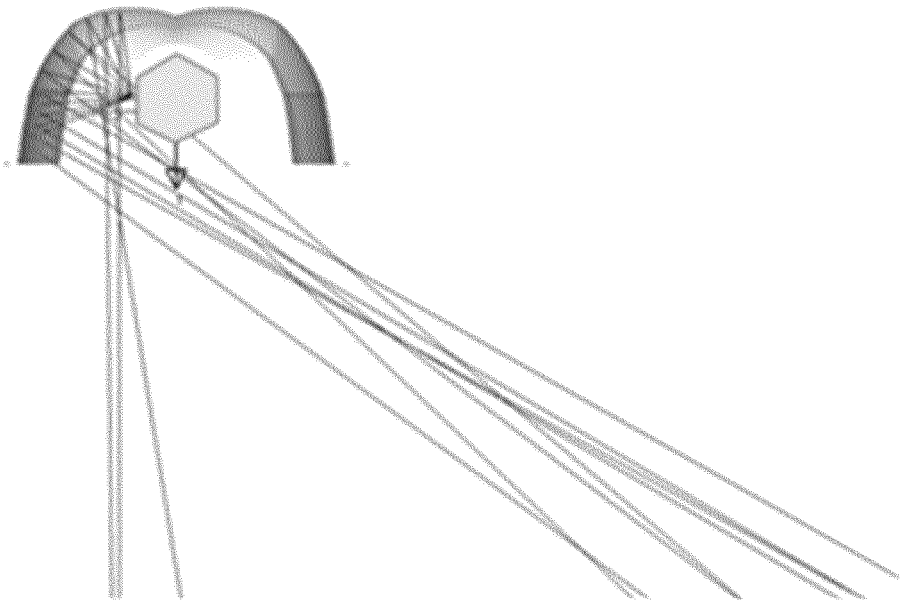
FIG. 17 shows a ray tracing simulation of a lighting module according to the invention mounted in a luminaire.

FIG. 17 shows a ray tracing simulation similar to the ones shown in FIGS. 1 and 2, but with an embodiment of the lighting module of the invention placed in the reflector 2 of the luminaire. When compared to lighting modules of the prior art (FIG. 2), it can be seen that a reduced amount of light emitted from the first surface is reflected back towards the lighting module 1, whereby a higher amount of light reaches the light window 24 of the reflector. The lighting module 1 of the invention therefore provides a better efficiency when installed in the luminaire than LED lamps of the prior art.

The invention claimed is:

1. A lighting module for use in a luminaire, comprising a heat sink for dissipating thermal energy, which heat sink is polygonal in cross section, forming a number of surfaces corresponding to the polygonal shape of the heat sink, each surface extending in a longitudinal direction, said longitudinal direction extending substantially perpendicularly to a plane of said cross section, each surface having a centre line extending in said longitudinal direction, at least two LEDs being located on each of at least three of said surfaces, wherein all of the LEDs on a first of said at least three surfaces are arranged on one side of the centre line, or at least one of the LEDs is arranged along the centre line of said first surface and the remainder of the LEDs are arranged on one side of the centre line, therewith define an accumulated light emitting area of said first surface, which accumulated light emitting area is distributed asymmetrically in relation to the centre line of said first surface.

2. The lighting module of claim 1, wherein at least some of the at least two LEDs on the first surface are arranged in a row extending in the longitudinal direction.

3. The lighting module of claim 2, wherein every second LED in the row has been displaced so as to increase the distance between neighboring LEDs of said row.

4. The lighting module of claim 2, wherein the row is arranged close to an edge of the first surface, preferably next to said edge of the first surface, and/or wherein no LEDs are placed on the centre line of the first surface.

5. The lighting module of claim 1, wherein the first surface comprises a reflective area.

6. The lighting module of claim 1, wherein the lighting module further comprises an LED driver capable of varying the electrical current to the at least one LED arranged along the centre line independently of the other LEDs of the first surface.

7. The lighting module of claim 1, wherein the heat sink has an elongated polygonal shape in cross section, and wherein the first surface has a greater cross-sectional width than at least some of the other surfaces.

8. The lighting module of claim 1, wherein multiple, preferably all, of said at least three surfaces are configured like the first surface.

9. The lighting module of claim 1, wherein the at least two LEDs being located on each of said at least three of said surfaces are distributed on said surfaces such that the cross section is discretely rotationally symmetrical.

10. The lighting module of claim 1, further comprising a sensor adapted for sensing an orientation of the lighting module in relation to the luminaire, when the lighting module is installed in the luminaire.

11. The lighting module of claim 1, further comprising a rotation mechanism allowing the heat sink to be rotated with respect to a base of the lighting module.

12. The lighting module of claim 11, wherein the rotation mechanism is adapted for automatically orienting the first surface in a predetermined direction in relation to the luminaire when the lighting module is installed in the luminaire.

13. The lighting module of claim 1, wherein the heat sink is quadrilateral in cross section so as to comprise four surfaces, each surface comprising at least one row of LEDs with at least two LEDs in each row, wherein the at least one row of LEDs of the first surface is displaced from the centre line of the first surface such that the accumulated light emitting area is distributed asymmetrically with respect to the centre line of the first surface.

14. A luminaire or light fitting comprising a lighting module according to claim 1 and a reflector surface for reflecting light emitted from the lighting module, wherein the lighting module is fitted in the luminaire or light fitting such that the first surface faces a centre or centre line of said reflector surface; or faces in a direction opposite to a main illumination direction or a light exit window; or faces in a direction opposite a direction of earth gravity.

15. A method for replacing a gas-discharge lamp, such as a High Pressure Sodium (HPS) lamp, in a luminaire with a reflector surface for reflecting light emitted from the gas-discharge lamp, the method comprising the steps of removing said gas-discharge lamp, providing a lighting module according to claim 1, and mounting said lighting module such that the first surface substantially faces a centre or centre line of the reflector surface; or faces in a direction opposite to a main illumination direction or a light exit window; or faces in a direction opposite to a direction of earth gravity.

* * * * *